US007234740B2

(12) United States Patent
Alchin

(10) Patent No.: US 7,234,740 B2
(45) Date of Patent: Jun. 26, 2007

(54) STRIKER ASSEMBLY FOR A DOOR LOCK

(75) Inventor: Michael Brian Alchin, Mittagong (AU)

(73) Assignee: Azuma Design Pty Limited, New South Wales (AU)

( * ) Notice: Subject to any disclaimer, the term of this patent is extended or adjusted under 35 U.S.C. 154(b) by 196 days.

(21) Appl. No.: 11/018,560

(22) Filed: Dec. 21, 2004

(65) Prior Publication Data

US 2005/0167996 A1 Aug. 4, 2005

(30) Foreign Application Priority Data

Jan. 5, 2004 (AU) ..... 2004900034

(51) Int. Cl.
*E05B 15/02* (2006.01)

(52) U.S. Cl. ..... 292/341.19; 292/341.18

(58) Field of Classification Search ..... 292/341.18, 292/341.19

See application file for complete search history.

(56) References Cited

U.S. PATENT DOCUMENTS

| | | | | |
|---|---|---|---|---|
| 852,553 | A * | 5/1907 | Georgenson | 292/341.19 |
| 1,214,227 | A * | 1/1917 | Schwenk | 292/341.19 |
| 4,451,071 | A | 5/1984 | Striese et al. | |
| 4,544,192 | A | 10/1985 | Angle et al. | |
| 5,757,269 | A * | 5/1998 | Roth et al. | 340/542 |

FOREIGN PATENT DOCUMENTS

| | | |
|---|---|---|
| CA | 2174785 | 10/1997 |
| GB | 2 230 294 | 10/1990 |
| NZ | 280 747 | 10/1997 |
| PL | 358 977 | 9/2003 |

* cited by examiner

*Primary Examiner*—Gary Estremsky
(74) *Attorney, Agent, or Firm*—Ladas & Parry

(57) ABSTRACT

A striker assembly (10) to be attached to a door jamb to engage the tongue of a lock mounted on an associated door, the assembly (10) includes a base (11) to be fixed to the door jamb and a striker member (15). The striker member (15) is adjustable relative to the base (13).

8 Claims, 4 Drawing Sheets

STRIKER ASSEMBLY FOR A DOOR LOCK

TECHNICAL FIELD

The present invention relates to strikers to be fixed to a door jamb and engaged by a lock tongue, the lock being mounted on a door associated with the door jamb.

BACKGROUND OF THE INVENTION

Both sliding and pivotally mounted doors are provided with a lock having a tongue, with the tongue being adapted to engage a striker to retain the door in the closed position. The striker is attached to the door jamb.

For the lock tongue to correctly engage the striker, there needs to be an accurate location of the striker and lock. Obtaining this correct location it is often time consuming and difficult. This is particularly evident in sliding doors where the doors are adjustably mounted on rollers.

OBJECT OF THE INVENTION

It is the object of the present invention to overcome or substantially ameliorate the above discussed problems.

SUMMARY OF THE INVENTION

There is disclosed herein a striker assembly to be engaged by a door lock, said assembly including: a base to be fixed to a door jamb; and a striker member adjustably fixed to the base and to be engaged by a tongue of the lock.

Preferably, said striker member is adjustable relative to the base in a generally horizontal direction.

Preferably, said base including a central portion with opposite ends with a projection at each end, with said member being located between the projections.

Preferably, the projections extend horizontally laterally from the central portion Preferably, said striker member is attached to said base by means of threaded fasteners, with the base having elongated apertures through which the fasteners pass to provide for adjustment of the member relative to the base.

Preferably, said apertures are elongated horizontally.

Preferably, said base and member are provided with abutting surfaces that have ridges and troughs to inhibit relative movement between the base and member when the threaded fasteners are tensioned.

Preferably, said base includes apertures via which the base is secured to the jamb with threaded fasteners.

Preferably, the base apertures are vertically elongated to provide for adjustment of the base relative to the door jamb.

Preferably, said assembly includes a cover secured to the base to conceal the base apertures.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
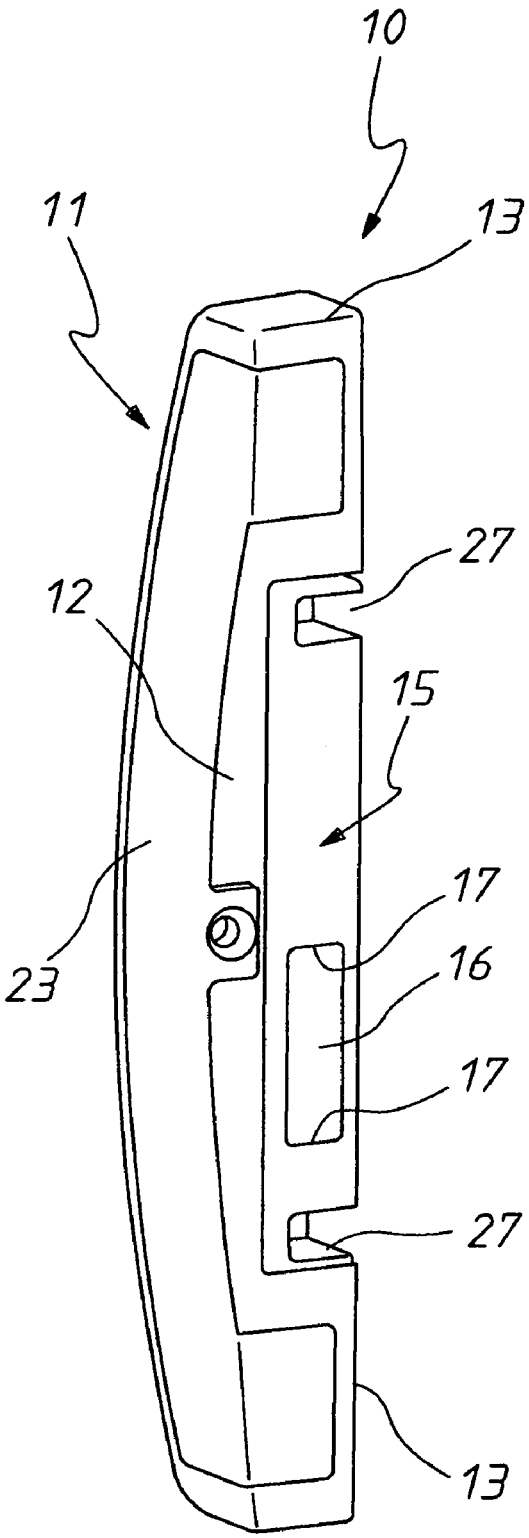
FIG. 1 is a schematic front isometric view of a door striker assembly.
Figure 2:
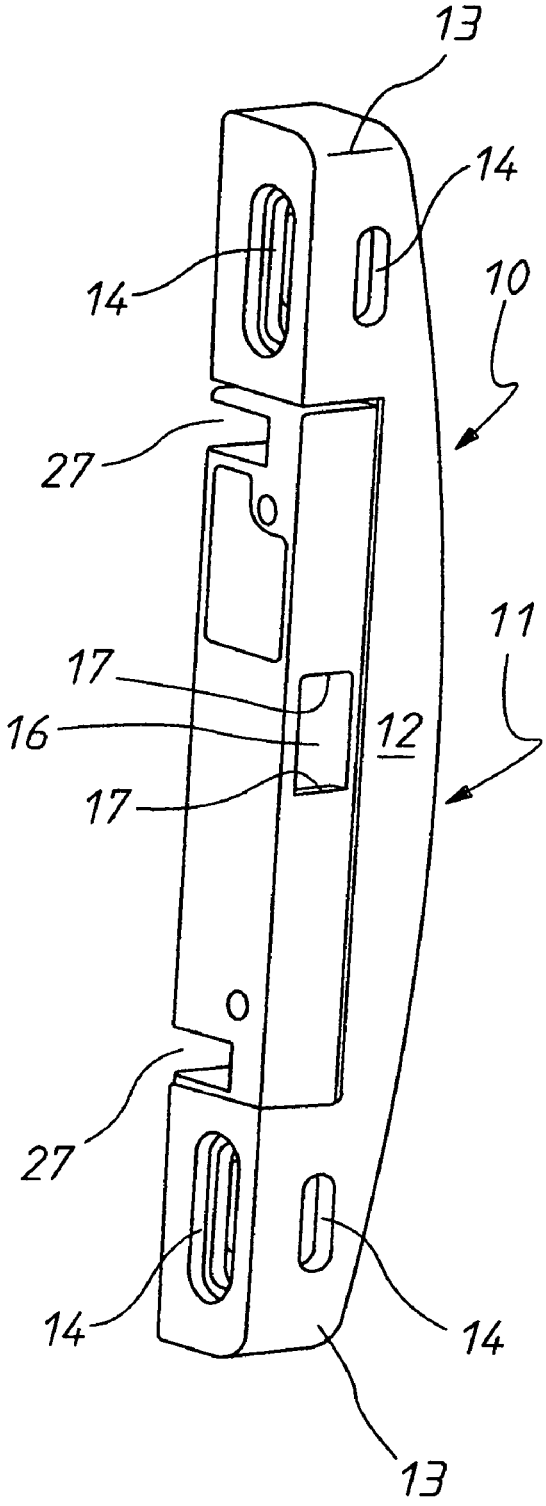
FIG. 2 is a schematic front isometric view of the door striker assembly of FIG. 1 with a cover member removed.

In the accompanying drawings there is schematically depicted a striker assembly 10 to be attached to a door jamb to engage the tongue of a lock mounted on the door operatively associated with the door jamb. In this particular embodiment, the striker assembly 10 is adapted to engage the "hook" tongue of a sliding door lock. However, it should be appreciated that the present invention is also applicable to strikers for pivotally mounted doors.

The assembly 10 includes a base 11 to be fixed to the door jamb. The base 11 includes a central portion 12 at the upper and lower ends of which there is provided projections 13. The projections 13 project horizontally laterally beyond the portion 12. The projections 13 are provided with apertures 14 through which threaded fasteners may pass to secure the base 11 to the door jamb. In this respect, it should be appreciated that the apertures 14 are vertically elongated so that the base 11 may be adjusted in height relative to the door jamb and therefore the door and lock fixed thereto.

Attached to the base 11 so as to be positioned between the projections 13 is a striker member 15. The striker member 15 has an aperture 16 with upper and lower edges 17 over which the "hook" tongue can engage. The member 15 has an abutment face 18 to engage a corresponding abutment face 19 on the central portion 12. Preferably, the faces 18 and 19 are roughened or provided with ridges and troughs so that when the striker member 15 is attached to the base 11, the surfaces 18 and 19 inhibit relative movement between the member 15 and the base 11.

The central portion 12 is also provided with apertures 20 that are horizontally elongated and through which threaded fasteners 21 pass to engage threaded passages 22 in the member 15. When the threaded fasteners 21 are tensioned, the member 15 is held in position between the projections 13. The member 15 can be adjusted by loosening the fasteners 21 and moving the member 15 relative to the base 11. When a desired position is located, the threaded fasteners 21 are tensioned so that the faces 18 and 19 are firmly held in frictional engagement.

A cover member 23 is secured to the base 11 by means of a threaded fastener 24 by passing through aperture 25 to engage threaded passage 26 in the base 11. The cover member 23 covers the threaded fasteners 21, and apertures 14 and 20.

Figure 3:
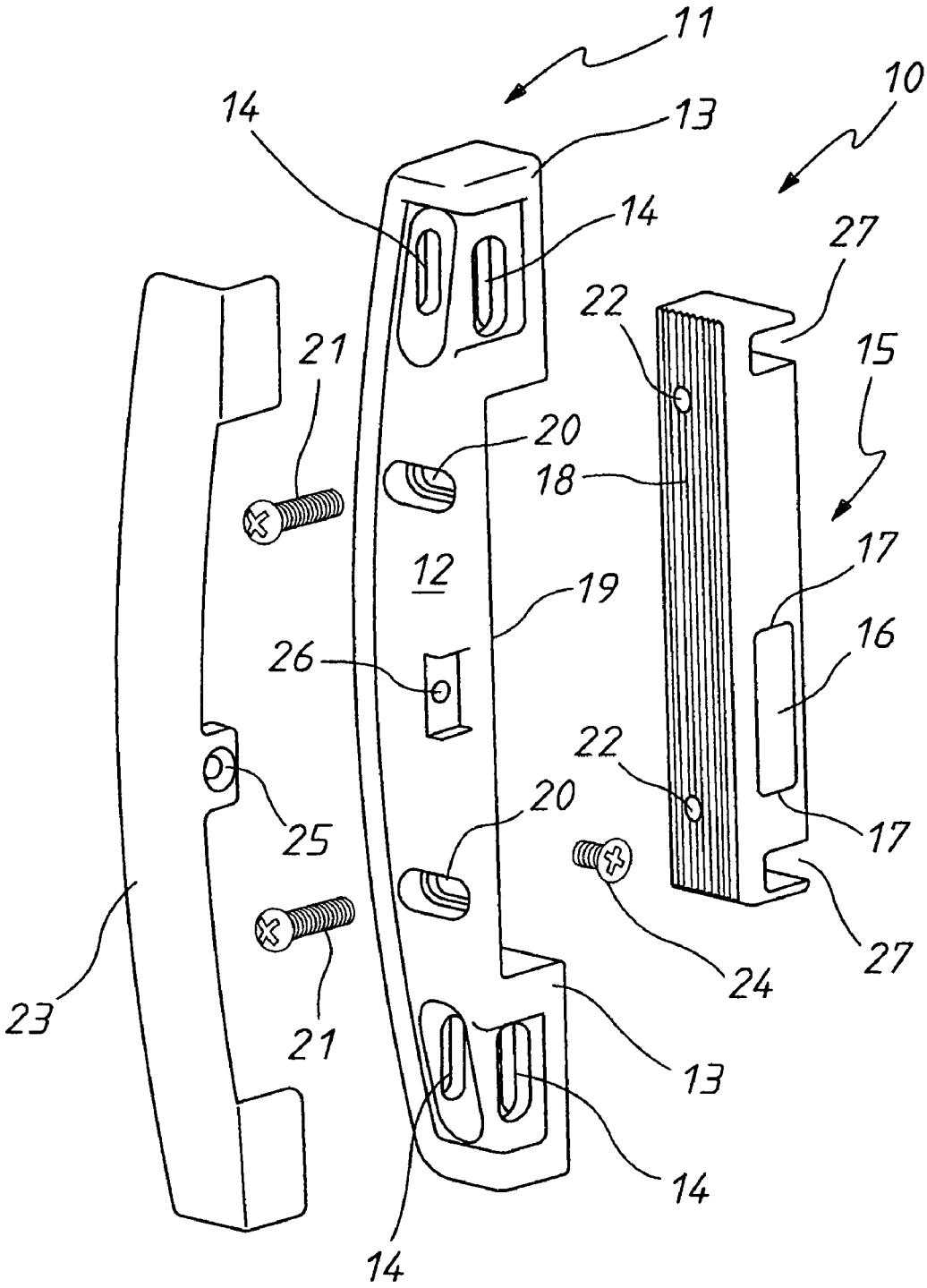
FIG. 3 is a schematic parts exploded perspective view of the striker assembly of FIG. 1.
Figure 4:
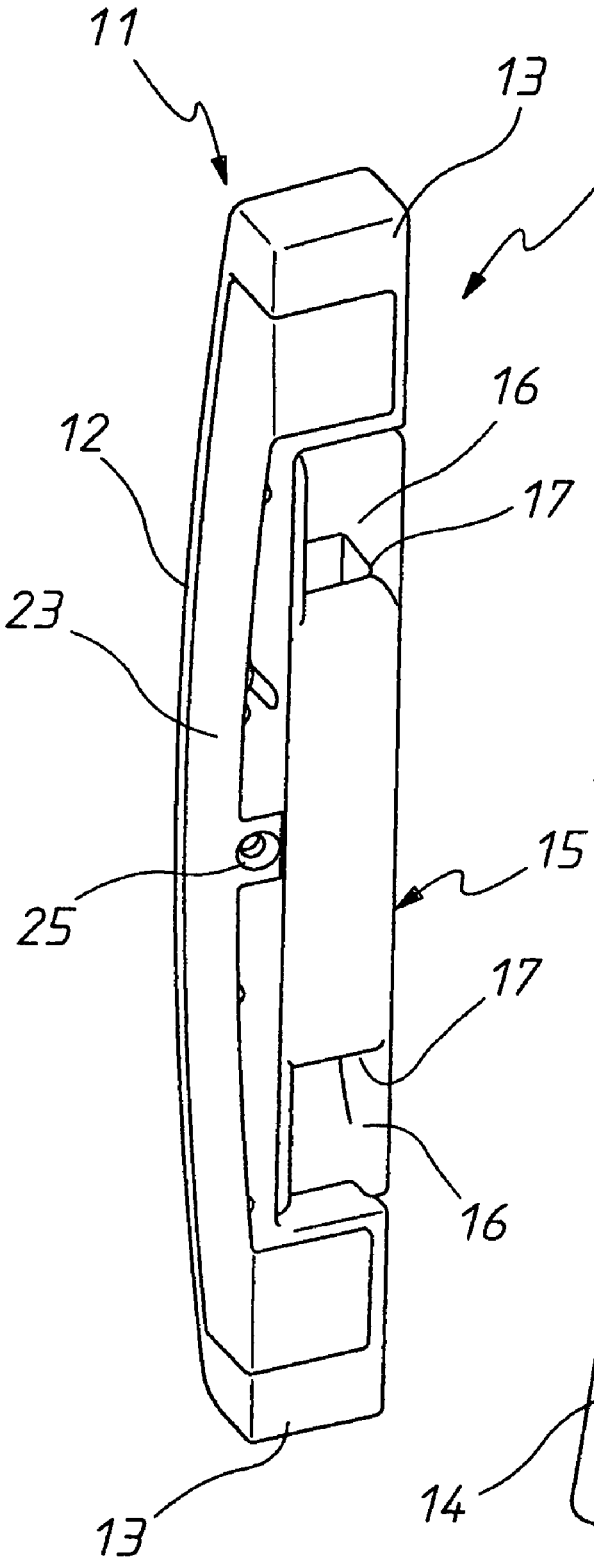
FIG. 4 is a schematic front isometric view of a modification of the striker assembly of FIG. 1.
Figure 5:
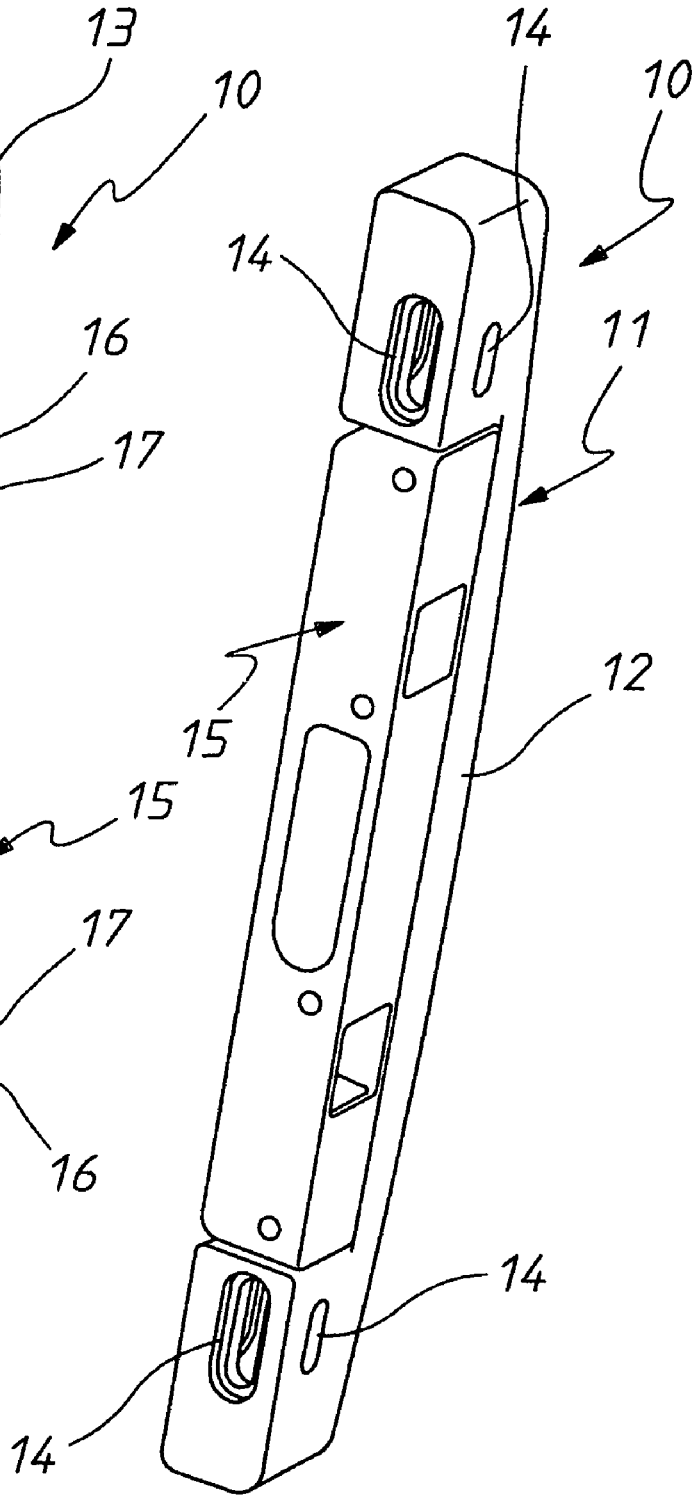
FIG. 5 is a schematic isometric view of the striker assembly of FIG. 4 with a cover member removed.
Figure 6:
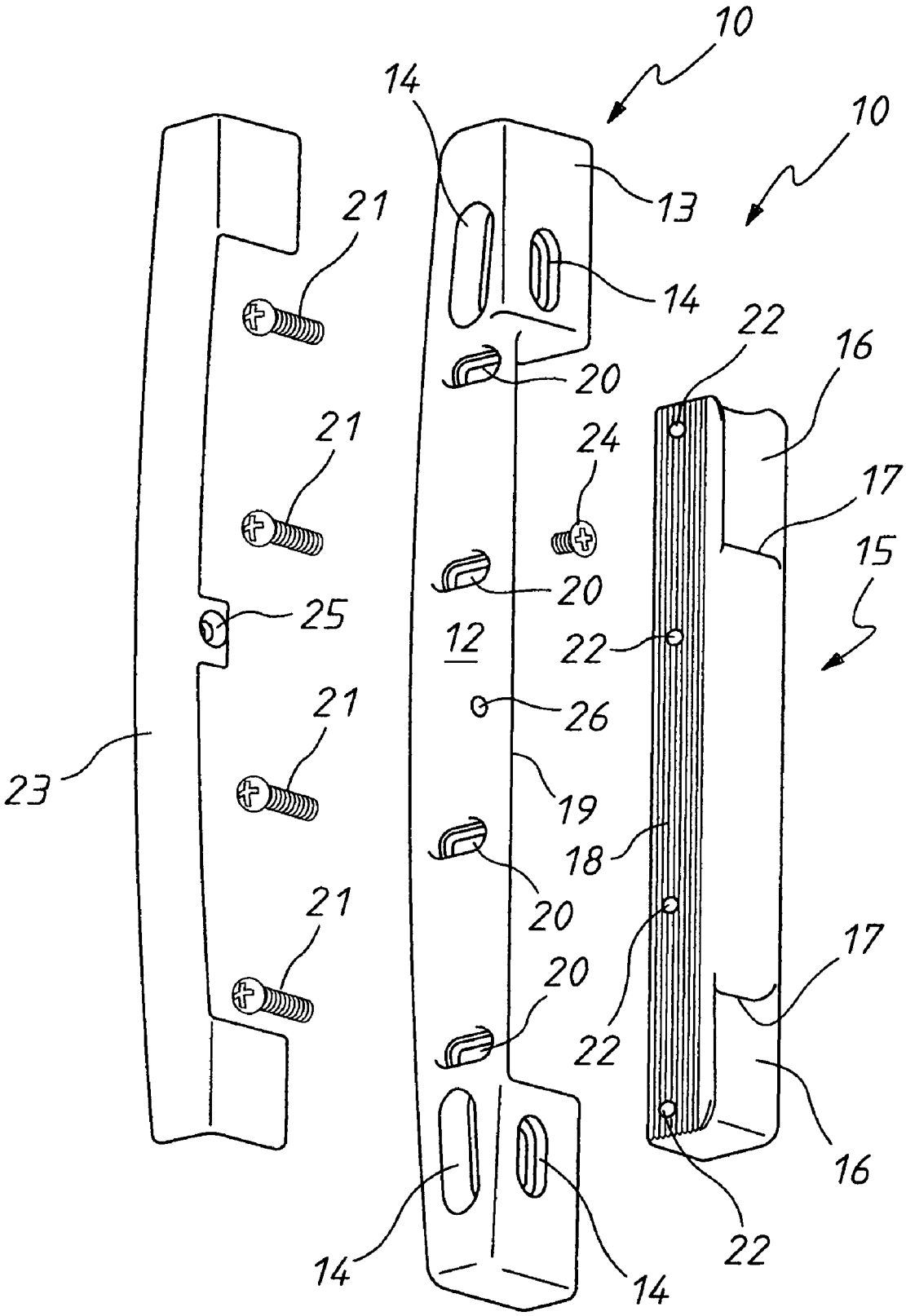
FIG. 6 is a schematic parts exploded perspective view of the striker assembly of FIG. 4.

In the embodiment of FIG. 3, the member 15 is provided with slots 27 into which projections of a sliding door lock would engage to inhibit lifting of the sliding door to remove the hook from engagement with the member 15.

In the embodiment of FIG. 10, the striker member 15 has apertures 16 and edges 17 over which a hook or hooks of the associated lock would engage.

The invention claimed is:

1. A striker assembly to be engaged by a door lock, said assembly including:

a base to be adjustably fixed to a door jamb, the base including an upwardly extending central portion with opposite upper and lower ends with a projection at each end, and first apertures through which threaded fasteners are to pass to attach the base to the door jamb, the first apertures being vertically elongated to provide for vertical adjustment of the base relative to the door jamb; and a striker member located between the projections and adjustably fixed to the base and to be engaged by a tongue of the lock, and wherein the assembly has second apertures through which threaded fasteners pass to fix the striker member to the base, the second apertures being horizontally elongated to provide for horizontal adjustment between the striker member and base.

2. The assembly of claim 1, wherein the projections extend horizontally laterally from the central portion.

3. The assembly of claim 1, wherein said base has said second apertures.

4. The assembly of claim 1 wherein said base has said second apertures.

5. A striker assembly to be engaged by a door lock, said assembly including:

a base to be fixed to a door jamb and having elongated first base apertures enabling generally vertical adjustment of the base relative to the jamb; and a striker member fixed to the base but adjustable relative thereto in a generally horizontal direction, and to be engaged by a tongue of the lock, wherein said base includes an upwardly extending central portion with opposite upper and lower ends with a laterally extending projection at each end, said member being located between the projections for movement relative to said base, and said striker member is attached to said base by means of threaded fasteners, with the base having elongated second base apertures through which fasteners pass to provide for horizontal adjustment of the member relative to the base.

6. The assembly of claim 5, wherein said second base apertures are elongated horizontally.

7. The assembly of claim 6, wherein said base and member are provided with abutting surfaces that have engaging ridges and troughs to inhibit relative movement between the base and member when the threaded fasteners are tensioned.

8. The assembly of claim 7, wherein the first base apertures are vertically elongated to provide for vertical adjustment of the base relative to the door jamb.

* * * * *